US007248230B2

(12) United States Patent
Piccionelli

(10) Patent No.: US 7,248,230 B2
(45) Date of Patent: Jul. 24, 2007

(54) ORNAMENT APPARATUS, SYSTEM AND METHOD

(76) Inventor: Gregory A. Piccionelli, 1925 Century Park East, Suite 2350, Los Angeles, CA (US) 90067

( * ) Notice: Subject to any disclaimer, the term of this patent is extended or adjusted under 35 U.S.C. 154(b) by 576 days.

(21) Appl. No.: 10/366,008

(22) Filed: Feb. 13, 2003

(65) Prior Publication Data

US 2004/0085258 A1 May 6, 2004

Related U.S. Application Data

(60) Provisional application No. 60/418,870, filed on Oct. 15, 2002.

(51) Int. Cl.
*G09G 5/00* (2006.01)
*H05B 35/00* (2006.01)

(52) U.S. Cl. ..... 345/2.1; 315/178

(58) Field of Classification Search ..... 345/1.1–3.4, 345/904; 315/178, 291, 185 R, 185 S; 362/122, 362/123, 237, 257, 561, 565, 567, 688, 562, 362/564, 583; 340/825.49, 7.46
See application file for complete search history.

(56) References Cited

U.S. PATENT DOCUMENTS

| | | | | |
|---|---|---|---|---|
| 5,300,864 | A | 4/1994 | Allen, Jr. | 315/314 |
| 5,511,148 | A | 4/1996 | Wellner | |
| 5,566,339 | A | 10/1996 | Perholtz et al. | |
| 6,002,853 | A | 12/1999 | de Hond | 395/200.49 |
| 6,393,419 | B1 | 5/2002 | Novak | |
| 6,690,120 | B2 | 2/2004 | Oskorep et al. | 315/178 |
| 6,777,891 | B2 * | 8/2004 | Lys et al. | 315/291 |
| 6,956,497 | B1 * | 10/2005 | Hindus et al. | 340/825.49 |
| 2001/0028227 | A1 | 10/2001 | Lys et al. | |
| 2002/0033779 | A1 | 3/2002 | Nakai et al. | |

FOREIGN PATENT DOCUMENTS

| | | |
|---|---|---|
| EP | 1134918 | 9/2000 |
| JP | 2001306048 | 11/2001 |
| WO | WO 9919854 | 4/1999 |
| WO | WO 9939328 | 8/1999 |
| WO | WO 0114981 | 1/2001 |
| WO | WO 0117262 | 3/2001 |

OTHER PUBLICATIONS

"IBM PC for user" by V.E. Figurnov, Infra PH, Moscow, 1997 [D2], pp. 81, 85 (in Russian).
"IBM PC for user" by V.E. Figurnov, Infra PH, Moscow, 1997 [D2], pp. 81, 85-86 (in Russian).

(Continued)

*Primary Examiner*—Kevin M. Nguyen
(74) *Attorney, Agent, or Firm*—Anna M. Vradenburgh; Gregory A. Piccionelli

(57) ABSTRACT

Embodiments of the present invention are directed to an ornamental system, apparatus and method that is dynamically modifiable. Embodiments of the ornament system comprise a processor, at least one ornamental member and a data controller. The processor is a computer which stores user input data for transmission and transmits a request for the transmission of data files. The ornamental member is configured to receive and display image data stored in a database, wherein the stored data can be changed at anytime. Embodiments of the present invention can be coupled to other ornamental systems across a wide area network, wherein users can share data files for display.

25 Claims, 7 Drawing Sheets

OTHER PUBLICATIONS

Telecommunications technologies, by L.M. Nevdiaev, pp., 483 1st & 2nd col.; p. 490, 1st col.

Terminology dictionary of electronic, ed. by G.N. Griazina et al., Politekhnika PH, 2001, p. 293, 2nd col.

* cited by examiner

ORNAMENT APPARATUS, SYSTEM AND METHOD

RELATED APPLICATIONS

This application claims priority from provisional patent application, Ser. No. 60/418,870, filed on Oct. 15, 2002, entitled "An Ornament Apparatus, System and Method", and is fully incorporated herein by reference.

FIELD OF INVENTION

The present invention is directed to an ornamental apparatus, system and method. More specifically, a programmable ornamental system and apparatus configured to receive and display user defined images, graphics and text, and a method for electronically coupling a plurality of ornamental apparatuses in a single location or a plurality of geophysical locations.

BACKGROUND OF INVENTION

Decoration of Christmas trees with ornaments, garland, tinsel and lights has been a tradition for millions of families for centuries. Indeed, millions of dollars are expended on Christmas tree decorations each year. Often times, ornaments are given as gifts to memorialize a visited place, or an event. Indeed, many families preserve Christmas tree ornaments which they have received from other family members and friends as keepsakes or even family heirlooms.

In addition to giving ornaments as gifts, many consumers collect ornaments. As such, consumers are interested in finding new and novel forms of ornaments, including different shapes, sizes, and colors. Additionally, consumers search for unique designs and compositions of ornaments, such as ornaments which include tinsel, electric lights, or consumable material. In light of the extremely large market for ornaments, consumers can find varying types of ornaments. Unfortunately, most of the commercially available ornaments are not of a personal nature for the individuals receiving or purchasing them.

To obtain more personal ornaments, some people make their own ornaments. For instance, hollow balls that can be filled with pictures or other materials are available, as well as, kits for painting precast ceramic ornaments, and clear plastic or glass balls. Although these ornaments allow the ornament to be personalized, once completed, these ornaments are static and cannot be changed. Further still, most people do not have the time to make these ornaments, and thus by default, they must avail themselves of the commercially available ones.

Traditionally, Christmas tree ornaments and similar objects have performed a simple ornamentation function and have not performed additional functions, such as interactive functions, wherein the ornaments provide users with the ability to play interactive games on or with the ornaments, or with other persons via the ornaments. Thus, the traditional ornaments usefulness is merely decorative.

A need in the industry exists for an ornamental system and apparatus which can be dynamically altered to suit the mood of the decorator to allow personalization of the ornament or to communicate multi-sensory information to one or more persons viewing, listening to, or otherwise encountering the ornament. A further need exists for an ornamental system, wherein a plurality of ornamental apparatuses can be coordinated within a single location or between multiple remote locations. A still further need exists for an ornamental system wherein persons may control one or a plurality of ornamental apparatuses on a Christmas tree or other location via controllers, such as computer game controllers or remote controls to provide users with the ability to play games or select content displayed on an ornament or a plurality of ornaments in a single location or multiple locations, including remote locations connected via a wide area computer network.

SUMMARY OF THE DISCLOSURE

Embodiments of the present invention are directed to an ornamental system, apparatus and method that is dynamically modifiable. Embodiments of the ornamental system comprise at least one processor, at least one ornamental member and at least one data controller. The processor is a computer which stores user input data for transmission and coordinates transmission of data to a single ornamental member or a plurality of ornamental members. Users or content providers input data files or other digital or analog information, including live information, via a user interface, wherein the data files include images, text, graphics, audio, video, audiovisual matter, haptic data, scent data, controller programs, including sensor and peripheral device interface programs, recognition programs, or any combination thereof. For example, the input data might be personal data to the user, such as family photographs, a holiday video or an old love letter. Additionally, the data can be a music file, such as an MP3 file, an audiovisual file, such as a home video, a haptic or texture data file, a scent or odor data file work, a game program, a file of any of the above types produced by a third party content provider, such as a professional content provider, or one or more combinations thereof.

The processor coordinates with the data controller to select and transmit data files to the ornamental member. The ornamental member comprises a display member which displays transmitted user or content provider information, wherein the information is received by the ornamental member via a receiving member and a body or housing. In some preferred embodiments, the ornamental member further comprises a variety of features, including, but not limited to, one or more means for attachment to a Christmas Tree, special effect generation means, including but not limited to an object, sound, light, motion, scent, odor, haptic, texture, smoke, or confetti, one or more light, sound, tactile, texture, haptic, heat, motion, chemical, radio signal and/or controller input sensors and/or information capture devices, one or more motors for producing motion and/or vibration, and a means for generating gaseous, liquid, semi-liquid and/or solid materials, such as smoke, colored smoke, confetti, glitter or Silly String®.

In some preferred embodiments, the ornamental member includes a data input and/or power input which comprises a connector or other means of attaching the ornament or a plurality of ornaments to one or more data or power delivery cables or wires, attachment node or other support, which may be strung or otherwise configured upon on a Christmas tree or other ornamental support object. In some embodiments, the data and/or power connector can also provide the physical means of attaching, fixing or hanging the ornament upon the Christmas tree or other ornament support. In some preferred embodiments, the limbs of an artificial or partially artificial Christmas tree can be configured to include on or within the limbs, branches, needles, or combination thereof, the hanging or attachment places for the ornaments which can also communicate data and/or power to the ornament via or in association with the hanging means.

The display member is a screen or any other device capable of displaying visual information, including, liquid crystal or plasma displays, LED displays or arrays, charged-couple devices, heads-up displays, holographic generators, projection display means, fiber optic displays, bioluminescent devices, electro-chemical displays, electron gun-based displays, micromirrors or any other digital light processing means, which is disposed on or integrated into the interior portion of the body of the ornamental member. In some preferred embodiments, the display member is integrated within a transparent, partially transparent or semi transparent portion of the body of the ornamental member. In instances where the display member is integrated into or disposed on the outer body of the ornamental member, the displayed image forms a dynamic component of the decorative or interactive features of the ornamental member. The body of the ornamental member can form any shape, thus, the transmitted data could be part of, or complimentary to, the shape of the ornamental member to enhance its decorative or interactive features. For example, data corresponding to a face can be transmitted to a head shaped portion of an ornament shaped as a human body. In some preferred embodiments, the shape of the ornament is dynamic whereby motion or shape reconfiguration means, such as electric motors can change the shape of the ornament in response to or in coordination with content displayed by the ornament. Ornament shape change may also be controlled by game programs, user instruction, such as by remote control or voice command or data received via a sensor or a remote user, such as by data transmitted to the ornament or ornament system via a wide area computer network.

An image displayed on the display member is projected for viewing by persons looking at the ornament. As the displayed data can be personal, such as an image of a family member, the ornamental member is transformed into a personalized decoration. For example, data comprising a video of the face of a family member can be projected via a display member in or on the head shaped portion of Santa Claus ornament.

In some preferred embodiments, the ornamental member can include a single display member or multiple display members. Thus, more than one data file can be displayed by a single ornamental member. In further embodiments, the ornamental member can combine display members which are located both within the interior of the ornament and on the outer body of the ornamental member such that the data displayed on the displays can be coordinated. For example, a display integrated into the outer body centered in front of a display located within the interior could allow the creation of effects such as simulated motion into or out of the ornament, three-dimensional looking scenes and other types of depth effects.

The receiving member is a signal receiving means, such as, an antenna, a wire transmission means, an optical transmission means, a biodigital interface, a sensor apparatus or any other data receiving means. In some preferred embodiments, the receiving member is embedded within the body of the ornament or is coupled to the exterior of the ornament, such as the top of the ornament, and is electronically coupled to one or more display members and to the processor. The receiving member receives data transmissions from the processor and transmits the data transmissions for display on one or more display members.

In addition to the receipt and display of images, in other preferred embodiments, the ornamental member can be configured to receive a variety of information. For example, in some preferred embodiments, the ornamental member can include one or more sound generating means, such as speakers, including vibrating membranes, and mechanical sound production means, such as a mechanical music box scent. In other preferred embodiments, sound generating means such as flat panel or planar magnetic speakers, for example sound generating devices similar to planar magnetic speakers sold by Sonigistixs, can be located within the outer member or integrated into the outer surface of the ornament. In still other embodiments, the ornamental member comprises a variety of enhancement devices, including, but not limited to, odor generating means, such as computer controlled reservoir release devices; tactile sensory stimulation means, such as, for example, motors to produce vibration; engines for production of special effects, such as the production of gaseous, liquid, semi-liquid or solid materials, such as smoke, "Silly String" or confetti; light effects generators, such as laser and strobe light generators; and chemical reaction output means.

To operate, an internal power source, such as a battery or solar cell, resides within, is coupled to, or is integrated into, the ornamental member. In some preferred embodiments, the ornamental member is coupled to an external power source such as the power source for decorative lights on a Christmas tree, or an independent power line which supplies power to one or more ornamental members. In some preferred embodiments, the power source can be power lines integrated into one or more artificial Christmas tree limbs and accessed by tapping into such lines via plugs, hooks or any suitable connector means. In further embodiments, the limbs of an entire artificial Christmas tree could be so configured to provide power to the ornaments.

The data controller is one or more software programs that operate in conjunction with the processor and is configured to control the selection of data transmitted to the ornamental member. The data controller includes a user interface which accepts user defined data. The user defined data is stored in a storage database coupled to the processor.

In operation, the controller, processor and ornamental member are in electronic communication with each other. Upon instructions from the processor to transmit data, the data controller retrieves the appropriate data files from the storage database and transmits the data to the receiving member of the ornamental member via the processor. The receiving member transmits the data to the display member for display on the ornamental member.

A feature of preferred embodiments is that ornamental members can electronically display personal data, such as video and audiovisual clips, photographs, images and text. An advantage to this feature is that ornamental members can be personalized. A further advantage to this feature is that the ornamental members can be personalized without the requirement for the user to personally decorate the ornamental member.

A further advantage is that the ornamental members can also display professionally produced data, including computer and video games, films, music videos, electronic greeting cards and the like. Another feature of preferred embodiments is that data files used for display on the ornamental members can be changed at any time. An advantage to this feature is that the ornamental members can display a variety of data such that the ornamental members are dynamic in appearance.

A still further feature of preferred embodiments is that a plurality of ornamental members can be coupled together. An advantage to this feature is that the set of ornamental members can be combined in a coordinated display. For example, in some preferred embodiments an array of several ornamental members can provide a means for displaying photographic, video or audiovisual matter from a plurality of angles on different ornamental members.

A further feature of preferred embodiments is that families in different geographic locations can display family data shared from a common database. An advantage to this feature is that only a single data file is required for use and thus, multiple copies do not have to be sent to other family members for sharing.

Another feature of preferred embodiments is that the ornamental members can include one or more cameras and/or microphones. An advantage to this feature is that families in different locations can transmit and receive live video and sound simultaneously via the Internet or other wide area computer network on a plurality of such ornaments. In this manner many geographically separated persons or branches of a family may simultaneously share their holiday via their respective ornament array.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of embodiments of the invention will be made with reference to the accompanying drawings, wherein like numerals designate corresponding parts in the figures.

DETAILED DESCRIPTION OF PREFERRED EMBODIMENTS

Figure 1:
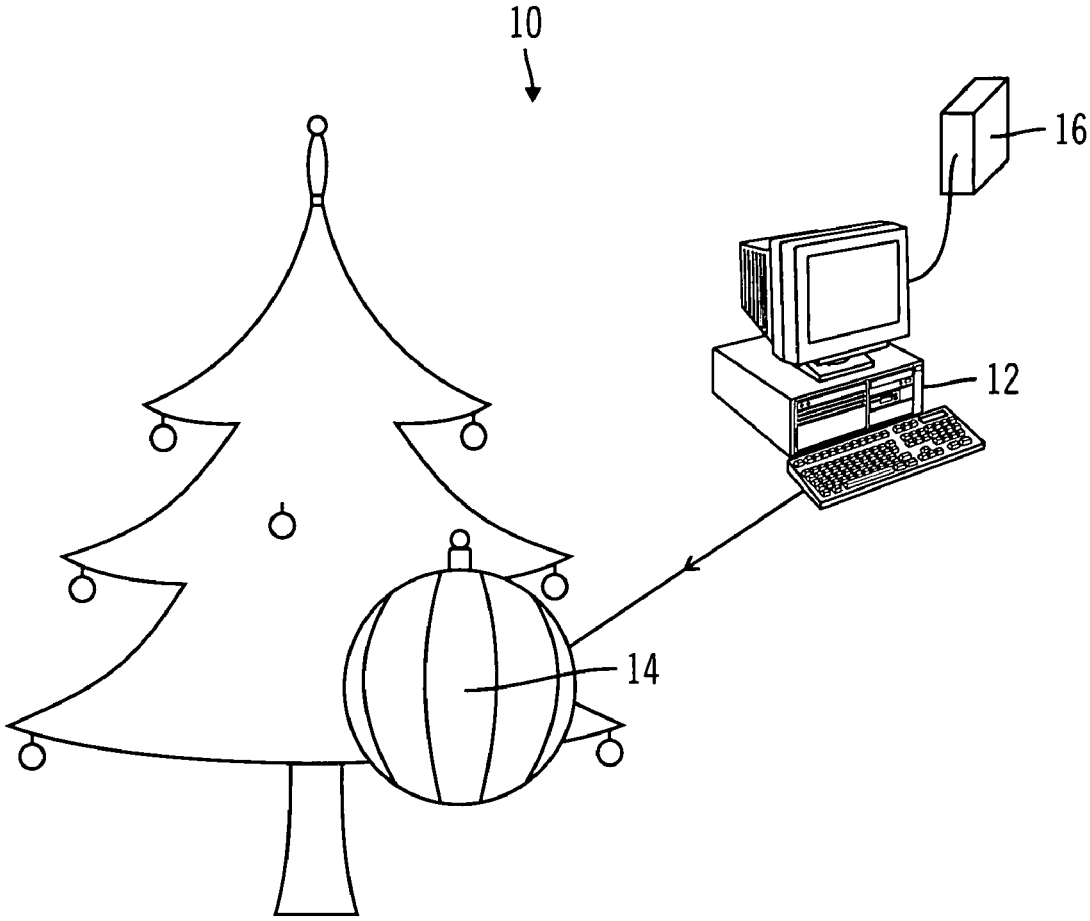
FIG. 1 depicts an ornamental system in accordance with a preferred embodiment of the invention.

The present invention is directed to an apparatus, system and method for an ornament. With reference to FIG. 1, embodiments of the ornamental system 10 comprise at least one processor 12, at least one ornamental member 14 and at least one data controller 16. The processor 12 is a computer which comprises a programmable processor capable of operating in accordance with programs stored on one or more computer readable media (for example, but not limited to floppy disc, hard disc, computer network, random access memory (RAM), CD Rom, and the like), a display device for providing a user-perceivable display (for example, but not limited to visual displays, such as cathode ray tube CRT displays, light-emitting-diode LED or liquid-crystal-diode LCD displays, plasma displays or the like, audio displays, scent or odor producing displays, tactile displays, special effects generators, light effect generators, motion generators, mechanical sound generators and chemical reaction devices), and a user input device (for example, but not limited to, a keyboard, mouse, microphone, camera, light, heat or motion sensors, game controller interface sensors, recognition system input devices, and the like, or any combination thereof). In one preferred embodiment, the controller comprises a personal computer system having a CRT display, a keyboard and a mouse user-input device. In some preferred embodiments, the controller 12 is coupled to other computers in a network, including, but not limited to, a closed or intranet configuration, an open or public-access network configuration or combinations of such configurations, as is well known in the art.

Figure 2:
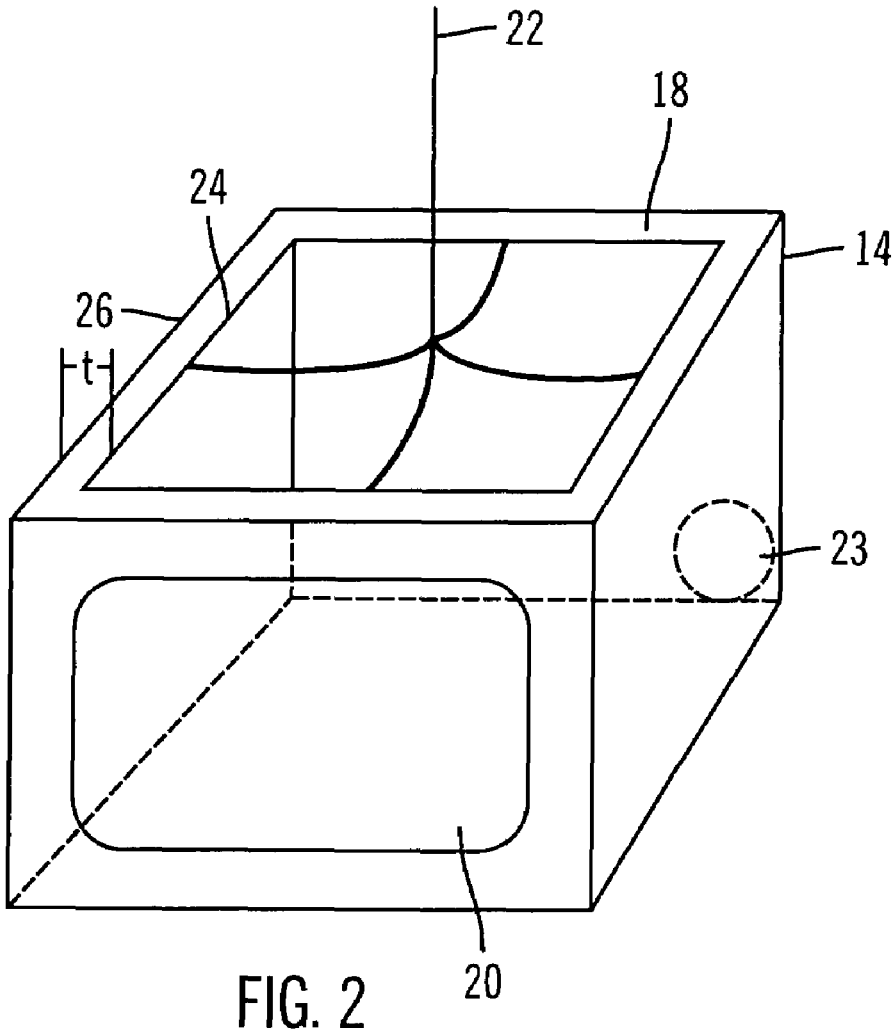
FIG. 2 is an ornamental member in accordance with a preferred embodiment of the invention.

With reference to FIG. 2, the ornamental member 14 is a decorative type member, such as an ornament for a Christmas tree. The ornamental member 14 comprises a body 18, a display member 20, a receiving member 22 and a power source 23. The body 18 is hollow and comprises an inner diameter 24 and an outer diameter 26, having a thickness t between the inner diameter 24 and outer diameter 26. In some preferred embodiments, the body 18 is a solid member. The body 18 can be made from a single contiguous piece or multiple segments coupled together. Further, the body 18 can be made from any materials, including, but not limited to plastic, ceramic, glass, aluminum and metallic alloys, and can form any shape, including, but not limited to, spheres, cubes, pyramids and squares. Further, the body shape can include irregular shapes, such as, for example, figures of characters, faces, animal bodies and celestial bodies. Further, the body of the ornamental member can be contiguous with or integrated into the body of one or more additional ornamental members, other decorative objects or a larger object such as an artificial Christmas tree.

Figure 3:
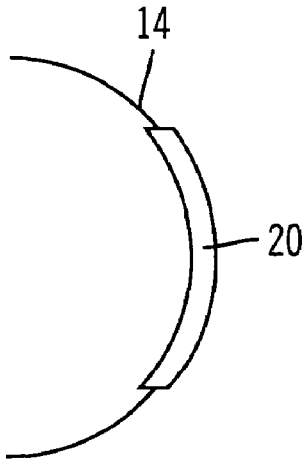
FIG. 3 is a display member coupled to the body of an ornamental member in accordance with a preferred embodiment of the invention.
Figure 4:
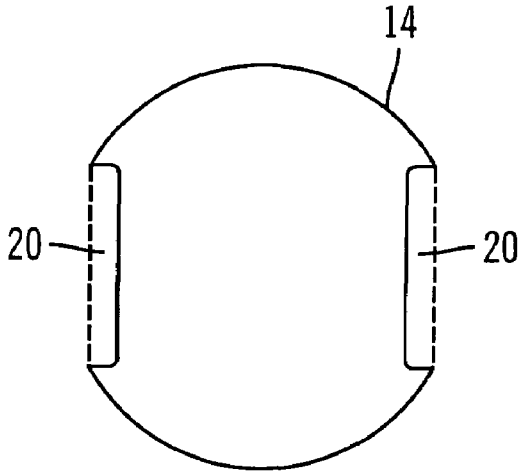
FIG. 4 is a display member embedded within the body of an ornamental member in accordance with a preferred embodiment of the invention.

The display member 20 is a screen, such as a liquid crystal device, or any other suitable device for displaying a digital or electronic image. With reference to FIG. 3, the display member 20 is disposed on the surface of the outer diameter 26, or, in some preferred embodiments (FIG. 4), is embedded between the inner and outer diameter such that the display member 20 is flush with the outer diameter of the body and forms a portion of the outer surface of the body 18.

Figure 5:
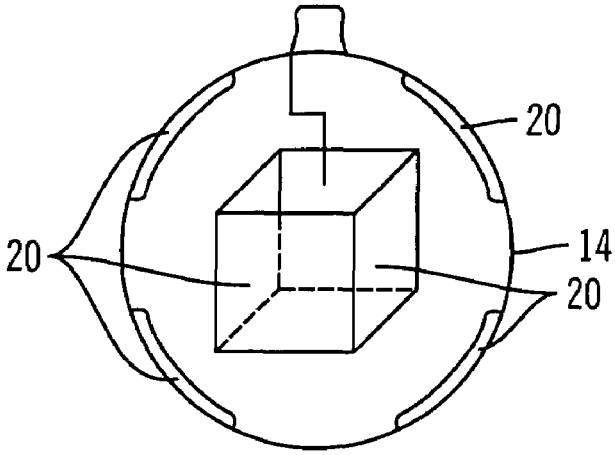
FIG. 5 is an ornamental member having a plurality of display members in accordance with a preferred embodiment of the invention.

The display member 20 can extend over the entirety of the body, thereby forming the body 18, or across a portion of the body. The display member 20 can be a contiguous member or can comprise several smaller members, wherein the combination of the smaller members form the entirety of the display member 20. An image displayed on the display member 20 will be projected such that the image can be viewed from the exterior of the body 16, such as, by a person looking at the ornament. If the display member 20 only extends across a portion of the body 18, the remaining portion of the body 18 can be decorated by any suitable means. With reference to FIG. 5, in some preferred embodiments, a plurality of display members 20 exist in single ornamental member 14, wherein each display member 20 can allow the viewing of an image, or groups of display members 20 can allow the display of a single image across the group of display members 20.

Figure 6:
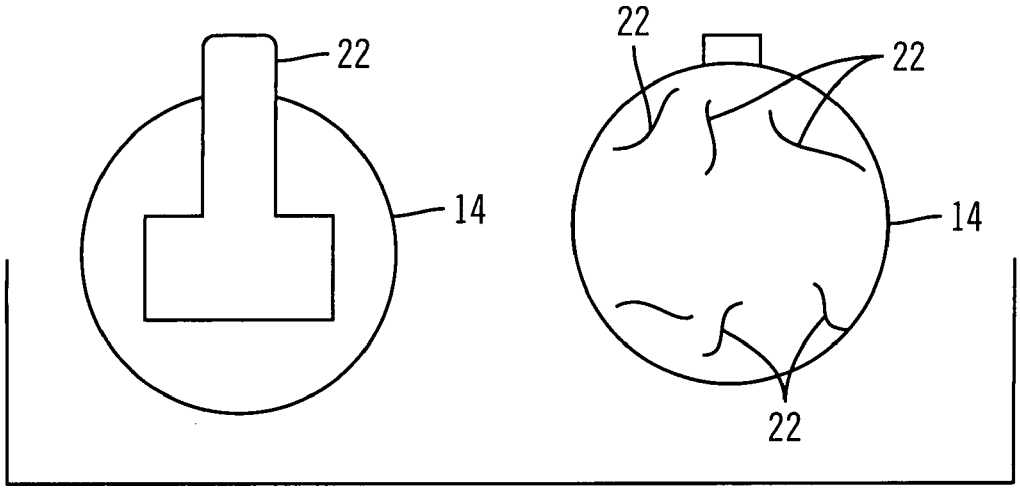
FIG. 6 depicts a receiving member embedded within the body or coupled to the body of the ornamental member in accordance with a preferred embodiment of the invention.

The receiving member 22 is a wire receptor or any suitable means of receiving data, including, but not limited to, an antenna, hard wired input means and optical data input means. In preferred embodiments, the receiving member can receive data transmitted by any means, including, but not limited to, data transmitted via radio transmission, such as Blue Tooth technology, optical transmission such as optical link means or by hard wire transmission. With reference to FIG. 6, in some preferred embodiments, the receiving member is embedded within the body 12 of the ornament or is coupled to the top of the ornament. The receiving member 22 is electronically coupled to the display member 22 and to the processor 12. The receiving member 22 receives data transmissions from the processor 12, or other similar device and transmits the data transmissions for display on the display member 22.

The power source 23 is an internal power source that resides within, or is coupled to, the body 18 of the ornamental member 14. In some preferred embodiments, the power source 23 is a battery, although any means capable of providing power to the ornamental member 14 such as a solar cell is suitable. In some preferred embodiments, the ornamental member 14 is coupled to an external power source such as the lights on the tree, or an independent power line that is plugged into an electric power supply.

In some preferred embodiments, the ornamental member further comprises a data storage means, such a Memory Stick reader, CD Rom drive, CD player, DVD player, videotape player, MiniDisc player, smart media reader or other such device. In some such preferred embodiments the data transmitted to the display member 22 is transmitted from the storage means contained on or within the ornamental member. In some preferred embodiments wherein the ornamental member includes a data storage device, such ornamental member can function as a processor whereby data contained in the data storage device is transmitted to one or more receiving ornament members for display on the receiving ornament members.

The data controller 16 is a software program that resides within the processor or is coupled thereto. The data controller 16 is configured to control the selection of data transmitted to the ornamental member 14. The controller 16 includes a user interface which accepts user defined data and instructions for the transmission of the data. The user accesses the user interface and inputs and identifies data files or identifies their storage location. Additionally, the user can identity sources for data transmissions. To identify data files, locations and sources, the user defines data markers, wherein each data marker identifies a data file or a data transmitting source. In preferred embodiments, a plurality of data markers can be identified for each input data. For example, a data marker can identify a particular data file stored in the storage database, the storage location of a data file for retrieval, or the source from which to receive transmitted data. An identified source can include, but is not limited to, one or more cameras, a video cassette players, DVD players, CD players, other digital storage devices, including hard drives and media readers, microphones, one or more ornamental members which are configured with data input devices, remote sensors, including tactile data sensors, broadcast sources, such as radio, television, and satellite and cable transmissions. As evinced from the discussion, the data markers need not be associated with particular input data, but rather, can identify a source from which any data could be transmitted. In this regard, a source capturing live transmissions can be identified without association to a particular data file.

The user defined data markers are stored in a storage database coupled to the processor 12. As discussed above, if the data marker is the identification of a data file being input by the user, the data file itself is stored in the storage database. If the data marker identifies a source for data, the source device is coupled to the ornamental system. As discussed below, the markers can be used to create instructions for transmitting data.

If the user desires to enter non-computer compatible data, such as an actual photograph, the user first converts the data by any suitable means, including scanning images. The converted data file can then be converted into an appropriate format via external devices, or in some preferred embodiments, the data controller will format the file prior to storing it in the storage database. The user defined data can include, but is not limited to, image, text, graphics, videos, digitized tactile data, motion capture data, data corresponding to scent or odor, and any combination thereof. The user defined data can include any type of data, including, but not limited to, family photographs, personal messages, letters, family movies and the like.

In preferred embodiments, the user interface facilitates the generation of instructions for use by the controller 16, wherein the instructions relate to the transmission of data from the controller 16 to the display member 20. The instructions can be general or can specify data markers in association with various parameters, such as, time or a specific display member. For example, the user can select the length of time that any data is displayed or, if multiple data files exist, can identify the data to be displayed for a specific time period. In preferred embodiments, the transmission of the data to the ornamental member is accomplished via any suitable means, including, but not limited to, blue tooth technology, wireless network means, or any other suitable means by which the information could be transmitted to the ornament. If more than one display member 20 exists in an ornamental member 14, the controller 16 can coordinate the display of data per display member 20, or can allow for the automatic distribution of data among the display members 20. In instances wherein the user inputs insufficient data, for example, one data file for multiple display members, or only inputs enough data for display by an ornamental member 14, for example, one data file per display member, in some preferred embodiments, a default instruction will distribute the data to the display members without instructions from the user. If a source for transmission is identified, the data transmitted from these sources will be distributed among the available ornamental members. In some preferred embodiments, a specific ornamental member can be predesignated to display data from a predefined source. In some of these instances, if no data is transmitted from the source, a default image is displayed.

In operation, the data controller 16, processor 12 and ornamental member 14 are in electronic communication with each other. When the system is powered, for example, the tree lights are plugged in, or the system is loaded into the processor, instructions to transmit data are forwarded to the controller 16. Upon receipt of the instructions to transmit data, the controller 16 retrieves the appropriate data files from the storage database and transmits the data to the receiving member 22 of the ornamental member 14 via the processor 12. The receiving member 22 transmits the data to the display member 20 for display. Once the image is transmitted to the display member 20 of the ornamental member 14, for example, the image of a loved one, a very personalized ornament is created. The ornamental member 14 is typically hung from a Christmas tree, and thus, adds to the personal nature of the holiday decorations. The image displayed in the ornamental member 14 can be changed at any time by the user storing new data or by instructing the controller 16 to transmit a different image file. As discussed above, instructions can be provided to the controller 16 prior to the use of the ornamental system, or data can be automatically distributed among the display members 20. By this means, users of the programmable ornamental system can transmit photographs, videographs, and/or audiovisual works of family members, deceased family members, friends, political or religious icons, and recordations of treasured family moments.

In other preferred embodiments, the ornamental apparatus comprises an auditory generating device, such as speakers, or mini generators, wherein the auditory generating device is configured to receive instructions from the data controller 16 to generate and produce the transmitted auditory data, such as sound associated with a video transmission. In some preferred embodiments, ornamental members 14 having auditory transmission capability do not include display members 20 such that the ornamental members 14 simply provide auditory data, such as a 'hello' and 'I love you' from grandma.

Further, in still other preferred embodiments, a proximity sensor is coupled to the ornamental member 14 such that during use of the ornamental system, when a person is within a predefined distance from the ornamental member 14, the ornamental member 14 automatically plays music or a video. In these instances, if the ornamental member 14 includes a display member 20, a static image is displayed on the display member 20 until the proximity sensor triggers the ornamental member 14 for dynamic display. In some preferred embodiments the ornaments also contain the means for performing recognition of persons by voice, face, digital identification signal generated by devices such as cellular telephones, and other such digital signals. In some preferred embodiments, an appropriately configured ornament could, for example, recognize a family member in the proximity of the ornament and display data directed to the particular family member on one or more ornament displays. For example, images of the family member at a young age or with grandma.

The above described embodiments have been described with reference to one ornamental member 14. However, it is to be understood that any number of ornamental members 14 can be coupled together. Indeed, a plurality of ornamental members 14 can be used to decorate a single tree. In these instances, the data controller 16 automatically, or upon directions input by the user, transmits data to each ornamental member 14 in the system. When a plurality of display members 20 exist in an ornamental member 14, the receiving member 22 is configured to process signals received from the controller 16 and discern through which display member 20 the processed data will be projected, that is, which display member 20 will receive the processed data.

In some preferred embodiments, the ornamental members 14 are coupled together via a power cord such that all ornamental members 14 are powered by a single source. In other preferred embodiments, a combination of power sources could be used to power a group of ornamental members 14, including, but not limited to, internal power sources and external power sources, wherein some of the ornamental members 14 are electronically coupled together.

The array of ornaments can provide the user with a coordinated performance of photographic, video and audiovisual content upon several ornaments. In preferred embodiments having auditory processing capacity, the receiving members 20 will also output processed auditory information to the sound generating devices, such as speakers, planar magnetic sound generators, or other mini generators resident within the body 16 or integrated into, or disposed upon the surface of, the outer part of the body of the ornamental member 14. To avoid overlapping auditory data, one set of speakers is typically used per ornamental apparatus regardless of the number of display members 20. However, coordination of speakers may be employed such that multiple auditory streams can be combined with the appropriate image data. In some preferred embodiments, the sounds produced by ornamental members having auditory transmission capability can be coordinated by the data controller to produce sounds which are related to one another, such as separate parts of a musical composition. For example, different musicians in a music video can each be displayed on separate ornamental displays simultaneously. Similarly, the sounds of different instruments can be played from different ornaments. Additionally, apparent movement of images and sound around a Christmas tree can be accomplished as such data is sequentially displayed from one ornament to another. In some preferred embodiments, such sounds, music, greetings, and the like, can be serially produced by the auditory transmission devices in separate ornamental members whereby one ornamental member produces a sound which ceases prior to the commencement of sound production by one or more other ornamental devices. It is to be understood that the present invention is not limited to any type of coordination of display by and among the ornaments, and contemplates the use of any type of such coordination and dynamic distribution of displays and data related thereto.

Figure 7:
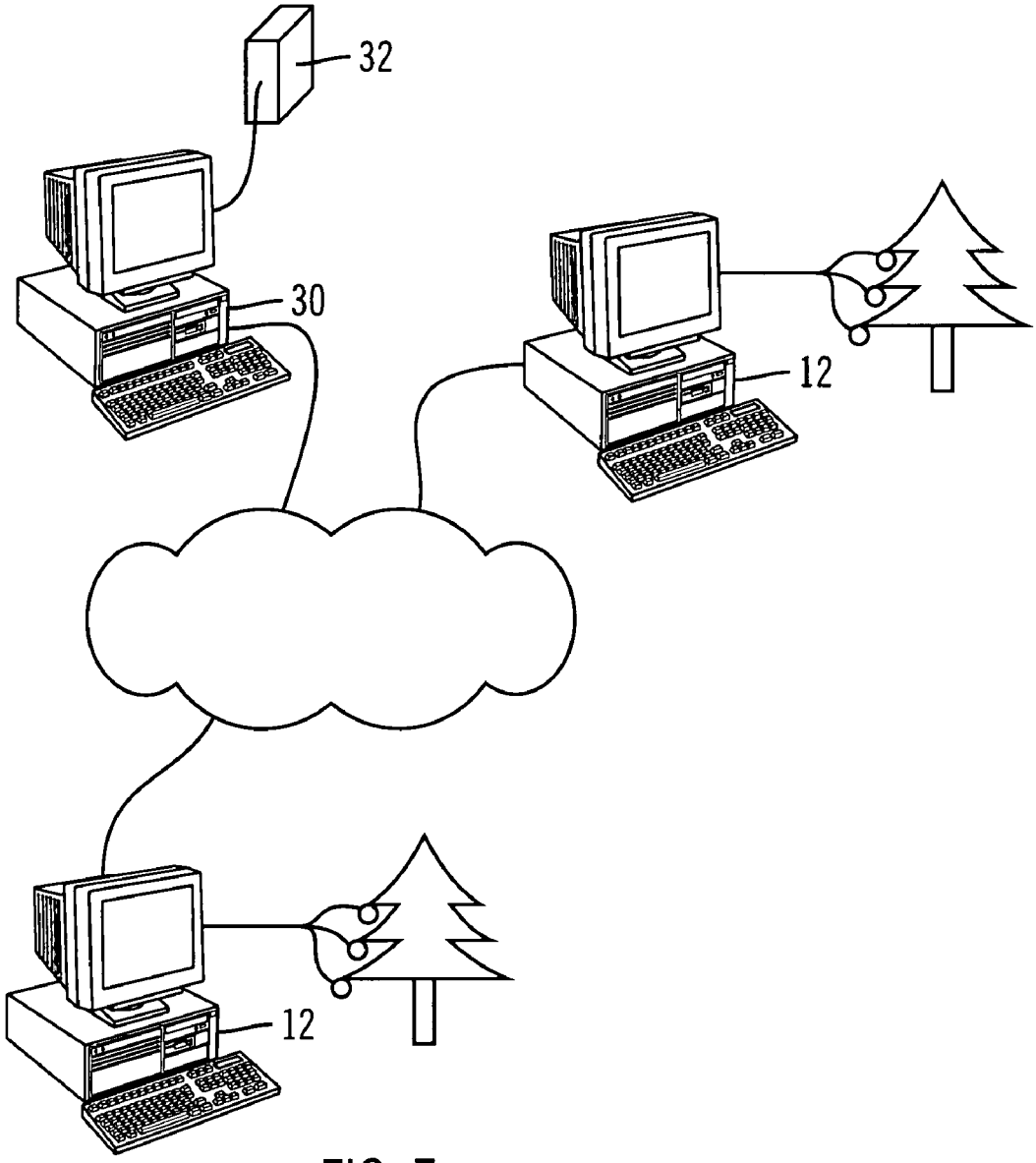
FIG. 7 is an ornamental network system environment in accordance with a preferred embodiment of the present invention.

It is to be further understood that the ornamental system can be operated on a network such as the Internet, or World Wide Web ("WWW"), such that a plurality of ornamental members 14 located in locations remote from each other can share user defined data. With reference to FIG. 7, a plurality of processors 12 are located in geographic locations remote from each other. In preferred embodiments, the user accesses a central processor 30, wherein a central data storage 32 exists which contains stored data files for use in the local ornament system. The files in the central data storage can be input via the local processor as described above. However, the files can be stored in a central storage location. The central processor 30 is configured to transmit predefined data files to each of the local processors 12. If desired, the local processors 12 can select data from the central data storage 32, can operate utilizing its own local images, or a combination of use. In these systems, users of the programmable ornamental system can transmit photographs, videographs, and/or audiovisual works of family members, deceased family members, friends, political or religious icons, and recordations of treasured family moments, live video, and video corresponding to video being captured in another location for transmission to a remote location via the Internet or other wide area computer network. Further still, if a user group, such as a family, establishes a peer-to-peer networking system, members of the peer-to-peer system can access the data files of other members for use on their local system, that is, image files among the family members can be shared from local storage databases. Further still, the system can be configured for sharing among unrelated users, wherein the data set for one or more ornaments or the entire ornamental array can be obtained from an external source. For example a user may want the ornament set currently being used at the White House or "Madonna's ornament program". In this regard, users can access data sets made available by other users, and further, can share their own data if desired.

In some preferred embodiments, the geophysical location of the ornament, determined by any means, such as a GPS detector, can function as a predicate for retrieval of appropriate programs and other audio, video, audiovisual, tactile, scent, and odor. In addition to providing useful options to the users and advertisers when such location information is used to send appropriate advertising information, this feature also provides users, such as parents with the ability to participate in content blocking systems whereby information is blocked from transmission to locations. Since it is contemplated that users may also use the ornamental input and output systems connected to the Internet and other networks for the purposes of wager-based gaming, the ability for a provider of such services, or other services such as adult entertainment or other adult product advertising (tobacco products, alcoholic products, and the like), to be able to determine the location of the user would be critical to conform to laws pertaining to prohibition of gaming or distribution of such adult materials in certain locations.

In other preferred embodiments of the invention, the ornamental member can contain heat, fire and/or motion detectors which, when triggered can transmit data via communication with the processor to a user, a security company, fire department, police, or other appropriate personnel via the Internet or other wide area computer network. In still other preferred embodiments, such communication with a user can also be performed by outputting production by sound and/or light generation means in one or more of the ornaments themselves, instead of, or in addition to, notification via a wide area computer network .

In some preferred embodiments, the ornamental member can also include a device for determining its geographic location, such as a GPS receiver, whereby information relating to the location of the ornament can be transmitted via the controller to remote locations via the Internet or other wide area computer network. In further embodiments, notification of the triggering of heat, fire and/or motion detection sensors can be associated and transmitted with location information to assist a security company, fire department, police, or other appropriate personnel in responding to the proper location after receiving such notification.

In some preferred embodiments, advertisers can make advertising available for display via the ornament member displays. In further embodiments, such advertisements can be tailored and transmitted to specific ornament locations for maximum advertising efficiency. In still further embodiments, electronic greeting cards can be transmitted to the ornaments and displayed thereupon and therein.

Figure 8:
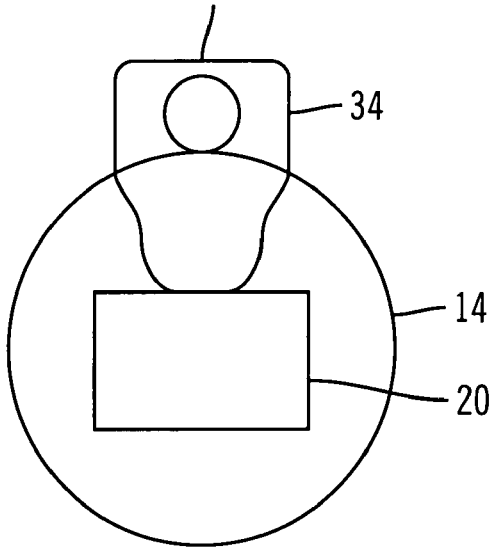
FIG. 8 is an ornamental member coupled to a camera in accordance with a preferred embodiment of the invention.

In addition to use on networks, or via stand alone computers, in some preferred embodiments and with reference to FIG. 8, the ornamental member 14 can be coupled to a wired or wireless camera 34. The camera 34 can be coupled to the ornamental member 14 or can be placed in any suitable location within the room, wherein the captured image data is displayed in the designated ornamental member. In addition to displaying the captured image data in the local ornamental members 14, the image data can be transmitted to other devices for display, such as computers, televisions, personal digital assistants, and to other ornamental members in remote locations. Thus, celebrations on the east coast can be shared with family members on the west coast via a wireless transmission or any other suitable means. In still other preferred embodiments, the ornaments can project images onto walls, or other appropriate surfaces.

In further embodiments, wherein the ornamental member includes one or more cameras, sound capturing devices and audio outputting devices, the ornaments can function as a means for providing translation services to persons with similarly configured ornaments. In such embodiments, two persons who speak different languages can associate a translator via the Internet or other wide area computer network. In this manner users can share their holiday experience with those that do not speak the same language.

Overall, each ornamental member 14 has one or more display members 20 and potentially some, or all, of the ornamental members 14 include sound generation means, such as speakers or a mini tone generator. The ornamental members 14 can work either by themselves or in series with each other, wherein information can pass from one ornamental member 14 to another via the controller. The number of display members 20 coupled to an ornamental member 14 is dependent, in part, on the size or style of the ornamental member 14. Each display member 20 displays photographs, video data, computer generated information such as graphical information. Further, sounds can be synchronized with the videos or correspond to the images or text. The sound can be synchronized or pertain to the visual information on the display members 20 of one ornamental member 14, or can be synchronized with visual information on many ornaments, or synchronized with audio information on several ornamental members 14, or any combination thereof. In some preferred embodiments, a set of ornamental members 14, such as fifteen ornaments, could correspond to a different tone or a different instrument or sound such that a song could be performed by the set of ornamental members 14, wherein the song could be a commercially prerecorded song or a user created song. In some preferred embodiments, the ornamental members can produce audio, sounds and music in response to MIDI control. In some of these embodiments, the ornamental member includes a MIDI sound generator.

Figure 9:
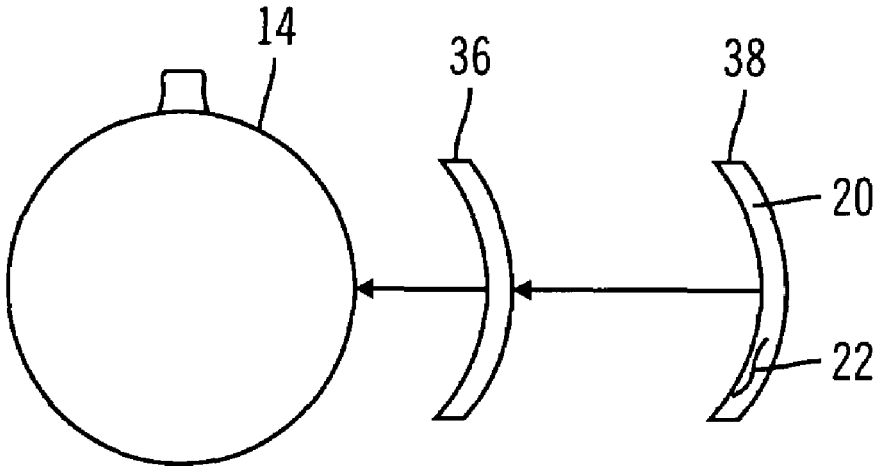
FIG. 9 depicts an attachable coupling member and an overlay member for attachment to an ornamental member in accordance with a preferred embodiment of the invention.

While the invention has been particularly shown and described with reference to a preferred embodiment thereof, it will be understood by those skilled in the art that various other changes in the form and details may be made therein without departing from the spirit and scope of the invention. For example, in some embodiments, the system can include an ornamental branch assembly wherein the branches are artificial and have prehung ornaments, or wherein the branches are the power means for the system such that attaching the ornaments to the branches activates the system. Further, in other preferred embodiments an individual ornament can have its own internal data storage for audio, video, audiovisual files, and the like. In further embodiments, an ornament can also function as dictaphone, photo, video, audiovideo or tactile capture device whereby such data is stored in the ornament and/or is transmitted to one or more external data storage devices. In still other embodiments, ordinary ornament bulbs can be modified with adhesive attachments. For example, with reference to FIG. 9, a coupling member 36, such as a magnetic piece, can be coupled to the commercially made ornament bulb, for example, by glue, and an overlay 38, for example, an overlay having a magnetic backing, could be coupled to the bulb, for example, magnetically, wherein the overlay 38 includes a screen, a chip, and an antenna. A single overlay, or a plurality of overlays could be placed on a single ornament. The overlay could be made in any shape, including, but not limited to, a square, circle or rectangular strip that wraps around the bulb, and can be coupled by any suitable means. Larger overlays could include more than one screen, such that multiple screens could be displayed on the ornament. In this manner, a user can easily modify existing or inexpensive ornaments to create the system.

In still further embodiments, replaceable canisters for the effect generation means are included. For example, replacement canisters for scent production, silly string, confetti, and the like, are coupled to an individual ornament or by other suitable means.

In some other preferred embodiments, the ornaments can be manually or automatically switched from a primary to a secondary, or tertiary, data controller, such as, for example, a television remote controller. In this regard, the programs on the ornaments can be controlled to change the display on the ornaments. Further still, a ribbon could contain a series of displays, wherein the ribbon is placed around the tree, in a manner similar to garland. In this regard, different screens could be activated on the ribbon at different places on the tree.

Figure 10:
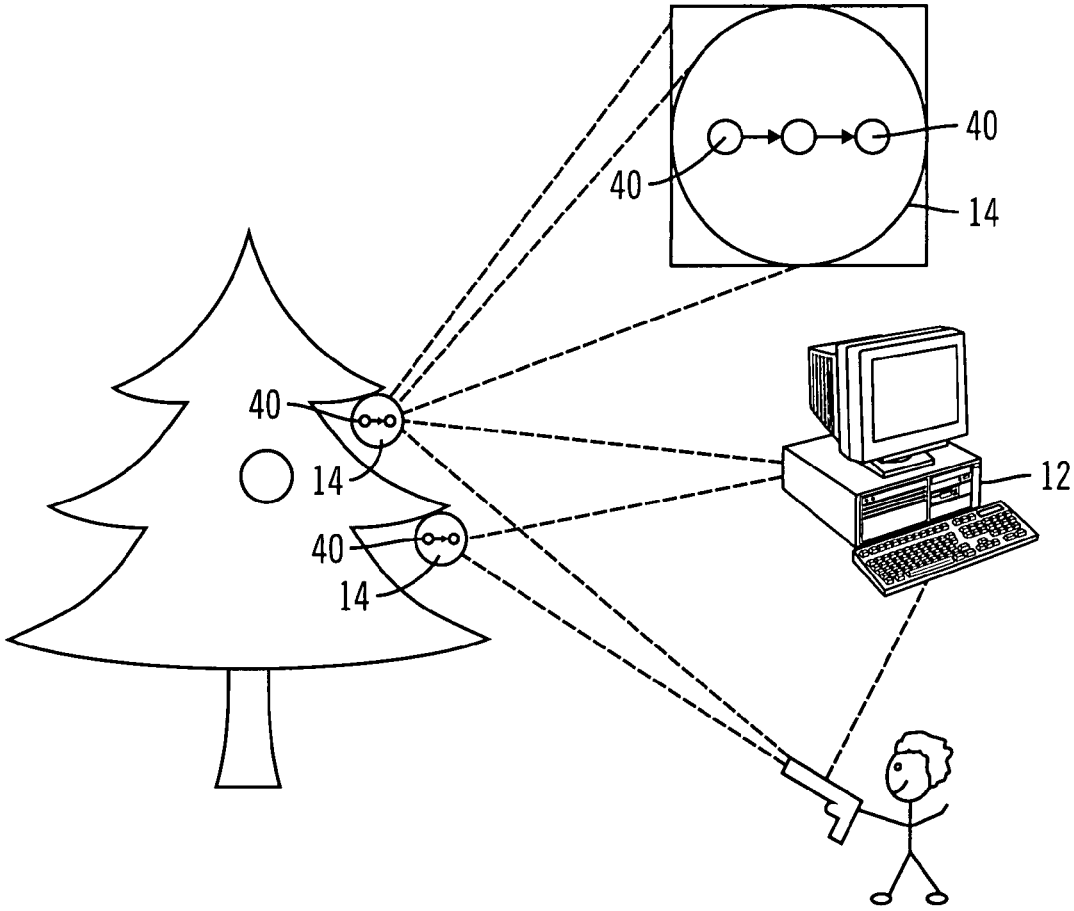
FIG. 10 depicts a user utilizing a game controller in a preferred embodiment of the invention.

In further preferred embodiments, the ornamental member contains sensors and interface means for receiving signals from game controllers. In these embodiments, the ornamental members and the displays associated therewith can function as components of a gaming system. With reference to FIG. 10, for example, a person with a game controller such as a light rifle could engage in a game whereby targets 40 are simultaneously or sequentially displayed on the ornament displays and the user attempts to shoot the targets thereby displayed. When the user has properly aimed and fired at a target so displayed, the game controller sensor, in this case a light sensor, can register a successful action and product notification thereof, such as by changing the display to indicate the successful action and/or produce one or more sounds via the ornament's, or ornaments', sound generator(s). In this manner a Christmas tree configured with such ornaments simultaneously functions as a video or computer game system. In further embodiments, multiple players in communication with one another via the Internet or other network may also play such games with one another via the ornament system.

In some other preferred embodiments, the ornamental members 14 could generate different channels on the television network. For example, similar to different television channel information, different data can be sent to the internal screens of the television wherein a plurality of internal screens correspond to a plurality of different transmissions. If information is transmitted, for example, to a set of twenty-four ornaments of this type and outputted to twenty-four different stations from the television, cable or satellite network, a large number of different television stations, cable or satellite station channels would be displayed. Similarly, transmission to different web pages could be exhibited and, in this manner, dynamic web pages could be set up for distribution to Christmas trees through a subscription. In one preferred embodiment, a user, such as family member subscribes to a Christmas tree ornamentation website having a plurality of different web pages that are downloaded to the user's server, either as static web pages or URL addresses that received dynamic data. In this regard, the URLs, which received dynamic data, transmits the received dynamic data to the designated ornaments. Thus, live web cams from around the world, images of Christmas from around the world, different locations around the world, scenery, and the like, could be displayed on the user's Christmas tree in real time, wherein the web pages, which correspond to the live and dynamic web cams, is then transmitted to the user's cams, and/or are then transmitted to the user's home unit for distribution to the various ornaments which correspond to each one of the web pages. In this way, the user's Christmas tree displays a plurality of different Christmas scenes from around the world via the ornaments.

What is claimed is:

1. An ornamental system for use on a Christmas tree for the transmission and display of user defined data, comprising:

storage means for storing user defined data;

an ornamental member configured to attach to a Christmas tree, the ornamental member having an electronic display capable of displaying one or more of the following group: image data, text data and graphic data; and a controller, the controller being coupled to the ornamental member and the storage means, and being configured to control the selection of user defined data for transmission to the ornamental member.

2. An ornamental system as claimed in claim 1, wherein the ornamental member comprises: a body; a display member; and a receiving member; the display member and receiving member being coupled to the body, and the display member being in electronic communication with the receiving member.

3. An ornamental system as claimed in claim 1, further comprising:

a user interface, the user interface being configured to receive data markers from a user and store the data markers in the storage means, the data markers being associated with predefined user data, wherein the controller selects data markers from the storage means and causes the transmission of the data associated with the data markers to the ornamental member; and a receiving member, wherein the transmitted data is received by the receiving member and transmitted for display on the display member.

4. An ornamental system as claimed in claim 3, wherein the data markers consist of any in the following group: data files consisting of instructions for the display of user defined data, data location identifiers and data source identifiers.

5. An ornamental system as claimed in claim 4, wherein the instructions for the display of data is selected from the group consisting of instructions associated with the timing of the transmission, the data to display, and instructions to randomly display data.

6. An ornamental system as claimed in claim 1, further comprising a central processor, a central storage database and a plurality of remote processors, the central processor and remote processors being coupled together on a computer network, wherein each processor in the plurality of processors reside in geographically distinct locations.

7. An ornamental system as claimed in claim 1, the ornamental system operating on a computer network further comprising:

a central processors, and a user processor, the user processor residing in a geographically remote location from the central processor, the user processor being coupled to at least one ornamental member a central storage database;

means for receiving user defined data from the central database;

means for transmitting selected data to the user processor, wherein the user processor transmits the selected data to the ornamental member for display on the display member.

8. An ornamental system as claimed in claim 1, comprising a plurality of ornamental members, wherein at least two of the plurality of ornamental members are configured to display data cooperatively in a predefined manner.

9. An ornamental system as claimed in claim 8, wherein the display data is selected from the group consisting of text, graphics, video and audiovisual.

10. An ornamental system as claimed in claim 8, wherein at least some of the plurality of ornamental members further comprise a sound generating device, and wherein the cooperative display of data is selected from the group consisting of: sequentially displaying image data from one ornamental member to another ornamental member; producing coordinated audible sounds from one ornamental member to another ornamental member; producing an audible musical composition wherein each instrument producing the musical composition is associated with a specific ornamental member such that the musical sound for that instrument is transmitted via the specific ornamental member; and serially producing audible sound from the sound generating device of an individual ornamental member, wherein one ornamental emember produces a sound which substantially ceases prior to the commencement of a sound produced by one or more ornamental members.

11. An ornamental system as claimed in claim 1, wherein the image data is video data.

12. An ornamental system as claimed in claim 1, wherein the user defined data is selected from the group consisting of: data markers, image data, text data, and graphic data.

13. An ornamental system as claimed in claim 1, further comprising an artificial Christmas tree having artificial limbs, branches and needles, wherein at least one of the limbs, branches or needles comprise an attachment means configured to receive the ornamental member.

14. An ornamental member being configured to attach to a Christmas tree and being configured to receive input data from a data source, comprising:

a body;

a display member, the display member being configured to display one or more of the following group of input data: image data, text data and graphic data; and a receiving member, the receiving member being configured to receive the input data; the display member and receiving member being coupled to the body, and the display member being in electronic communication with the receiving member.

15. An ornamental member as claimed in claim 14, wherein the body comprises a hollow interior and the display member is disposed within the interior of the body.

16. An ornamental member as claimed in claim 14, wherein the data source is selected from the group consisting of a processor, video player, CD player, and a network server.

17. An ornamental member as claimed in claim 14, further comprising an auditory generating device, the auditory generating device being coupled to the body and being configured to generate audible sound.

18. An ornamental member as claimed in claim 12 further comprising a camera and sound capturing device, the camera and sound capturing device being coupled to the body.

19. An ornamental member as claimed in claim 14, wherein the body further comprises an inner diameter and an outer diameter, and further comprising a plurality of display members, wherein at least one display member is disposed within the interior of the body and at least one display member is disposed on the outer diameter, and wherein the input data displayed on the display residing within the interior of the body and on the outer diameter is coordinated.

20. An ornamental member as claimed in claim 19, wherein the coordinated data display on the display members creates the effect of motion.

21. An ornamental member as claimed in claim 14, wherein the display member comprises a plurality of display member elements, wherein each display member element is capable of displaying a portion of an image data file, where in the portions of the image files for at least two of the plurality of display member elements collectively display the image file.

22. An ornamental member as claimed in claim 14, further comprising:

a controller, the controller being coupled to the body and being configured to control the selection of input data from the data source for transmission to the ornamental member.

23. An ornamental member as claimed in claim 14, wherein the display member is selected from the group consisting of: a liquid crystal display, a plasma display, and a bioluminescent display device.

24. An ornamental member as claimed in claim 14, wherein the body further comprises shape reconfiguration means, wherein the shape reconfiguration means being capable of reshaping the body in response to or in coordination with selected input data displayed on the display member, and wherein the body is configured to respond to the shape reconfiguration means.

25. An interactive ornamental system for use on a Christmas tree for the transmission and display of data, comprising:

storage means for storing data;

a plurality of ornamental members configured to attach to a Christmas tree, each ornamental member comprising:

an electronic display capable of displaying one or more of the following group: image data, text data and graphic data; and at least one sensor;

a first controller, the controller being coupled to the ornamental member and the storage means, and being configured to control the selection of data for transmission to the ornamental member; and a second controller for use by an end user, the second controller being configured to transmit at least one signal to the sensor of any of the plurality of ornamental members selected by the end user, wherein upon successful transmission of the signal to the selected ornamental member, the first controller selects new data for transmission to the ornamental member.

* * * * *